US006846251B2

(12) United States Patent
Moriyama

(10) Patent No.: US 6,846,251 B2
(45) **Date of Patent: *Jan. 25, 2005**

(54) GOLF BALL

(75) Inventor: Keiji Moriyama, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 82 days.

This patent is subject to a terminal disclaimer.

(21) Appl. No.: 10/223,640

(22) Filed: Aug. 20, 2002

(65) Prior Publication Data

US 2003/0050137 A1 Mar. 13, 2003

(30) Foreign Application Priority Data

Aug. 22, 2001 (JP) ..... 2001-251356

(51) Int. Cl.[7] ..... A63B 37/12
(52) U.S. Cl. ..... 473/383
(58) Field of Search ..... 473/378–385

(56) References Cited

U.S. PATENT DOCUMENTS

| | | | | |
|---|---|---|---|---|
| 4,813,677 A | | 3/1989 | Oka et al. | |
| 5,080,367 A | | 1/1992 | Lynch et al. | |
| 5,292,132 A | | 3/1994 | Oka | |
| 5,911,639 A | * | 6/1999 | Kasashima et al. | 473/377 |
| 6,346,053 B1 | * | 2/2002 | Inoue et al. | 473/378 |
| 2003/0109334 A1 | * | 6/2003 | Moriyama et al. | 473/383 |
| 2003/0134696 A1 | * | 7/2003 | Moriyama et al. | 473/378 |

FOREIGN PATENT DOCUMENTS

| | | | |
|---|---|---|---|
| GB | 2 342 867 A | | 4/2000 |
| GB | 2342867 A | * | 4/2000 |
| GB | 2 370 996 A | | 7/2002 |

* cited by examiner

*Primary Examiner*—Raeann Gorden
(74) *Attorney, Agent, or Firm*—Birch, Stewart, Kolasch & Birch, LLP

(57) ABSTRACT

A golf ball having a large number of dimples on the surface wherein the surface area occupation ratio Y of the dimples is 0.80 to 0.90; the mean occupation ratio y which is a value obtained by dividing the surface area occupation ratio Y by the total number of the dimples, is 0.00220 or more; the total contour length X of the dimples and the surface area occupation ratio Y satisfy the relationship indicated by an expression (I):

$$X \leqq 3882*Y+1495 \quad \text{(I); and}$$

number of dimples having a contour length x of 10.5 mm or more to the total number of dimples is 91% or more.

4 Claims, 13 Drawing Sheets

GOLF BALL

BACKGROUND OF THE INVENTION

The present invention relates to a golf ball and more particularly to an improvement in a in the dimple pattern of the golf ball.

A golf ball has approximately 200 to 550 dimples on the surface thereof. The role of the dimples resides in one aspect in that such dimples disturb the air stream around the golf ball during the flight to accelerate the transition of turbulent flow at the boundary layer of the golf ball, thereby causing turbulent flow separation (which will be hereinafter referred to as a "dimple effect"). The acceleration of the transition of the turbulent flow causes a separating point of the air from the golf ball to be shifted backward so that the drag coefficient (Cd) is reduced, resulting in an increase in the flight distance of the golf ball. Moreover, the acceleration of the transition of the turbulent flow increases the differential between upper and lower separating points of the golf ball which is caused by back spin. Consequently, a lift action on the golf ball is increased.

There have been proposed various golf balls having improved dimple patterns in order to enhance a flight performance. For example, Japanese Patent Publication No. Sho 58-50744 (U.S. Pat. No. 5,080,367) has disclosed a golf ball in which dimples are densely provided such that a that the pitch between the dimples is 1.62 mm or less, if possible. Japanese Laid-Open Patent Publication No. Sho 62-192181 (U.S. Pat. No. 4,813,677) has disclosed a golf ball in which dimples are densely provided so as not to form a new dimple having an area which is equal to or larger than the mean area in the land portion other than the dimples. Japanese Laid-Open Patent Publication No. Hei 4-347177 (U.S. Pat. No. 5,292,132) has disclosed a golf ball in which dimples are densely provided such that the number of land portions in which a rectangle having a predetermined dimension can be drawn is 40 or less.

All the golf balls disclosed in the known publications have densely provided dimples, in other words, the surface area occupation ratio of the dimple is increased. Those skilled in the art have recognized that the surface area occupation ratio is one of important elements which influence the dimple effect.

However, the surface area occupation ratio is not the only index which relates to the dimple effect. In this respect, in addition to the surface area occupation ratio, there is room for investigating other areas for further enhancing flight performance.

SUMMARY OF THE INVENTION

The present inventor has recognized that the mean occupation ratio, which is a mean value of an area ratio occupied by respective dimples, in addition to the surface area occupation ratio, is an important element which influences the dimple effect. The present inventor has studied the existing golf balls that have the same surface area occupation ratio to find that a golf ball that has a higher mean occupation ratio is more excellent in a flight performance. By establishing the relationship between the surface area occupation ratio and the mean occupation ratio within a range which is not obtained by the existing golf balls, the flight performance is enhanced.

The present invention provides a golf ball having a large number of dimples on a surface thereof. The surface area occupation ratio Y of the dimples is 0.80 to 0.90. The mean occupation ratio y which is a value obtained by dividing the surface area occupation ratio Y by a total number of the dimples, is 0.00220 or more.

A golf ball in which the surface area occupation ratio Y satisfies the range and the mean occupation ratio y satisfies the range includes a large number of dimples having comparatively large areas. The reason why the flight performance of the golf ball is excellent is not clear in detail. It is believed that the dimple pattern contributes to a reduction in the drag coefficient (Cd), particularly, a reduction in the drag coefficient (Cd) in a high-speed region immediately after hitting the golf ball.

It is preferable that a total contour length X (a sum of a contour length x of the dimple) and the surface area occupation ratio Y should satisfy a relationship indicated by an expression (I):

$$X \leqq 3882*Y+1495 \quad \text{(I).}$$

The golf ball includes a dimple pattern having a smaller total contour length X as compared with the surface area occupation ratio Y. Such a golf ball presents a more excellent flight performance.

It is preferable that the ratio of the number of dimples having a contour length x of 10.5 mm or more to the total number of the dimples should be 91% or more. Such a golf ball presents a particularly excellent flight performance.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

The present invention will be described below in detail based on a preferred embodiment with reference to the drawings.

Figure 1:
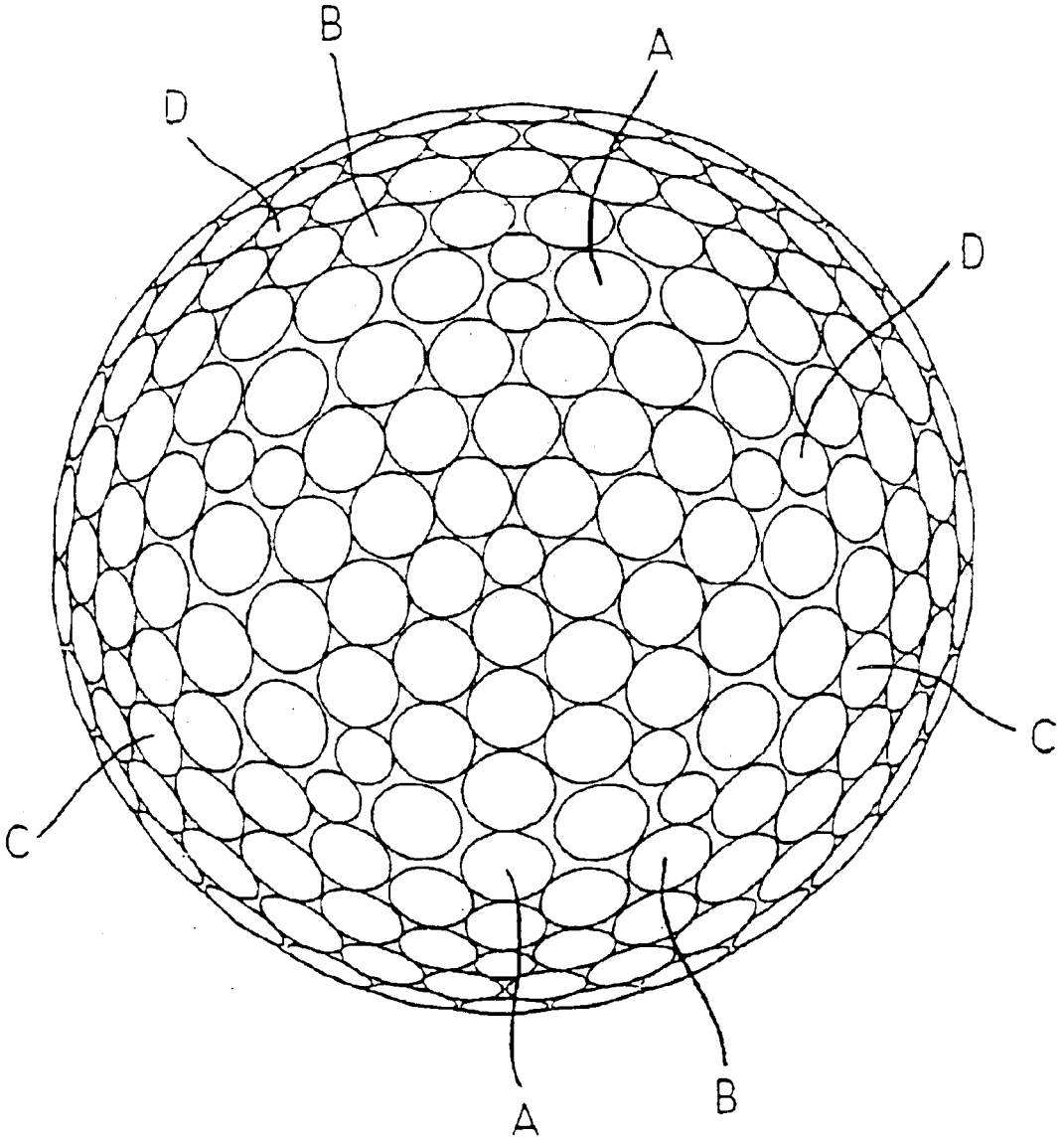
FIG. 1 is a plan view showing a golf ball according to an embodiment of the present invention.
Figure 2:
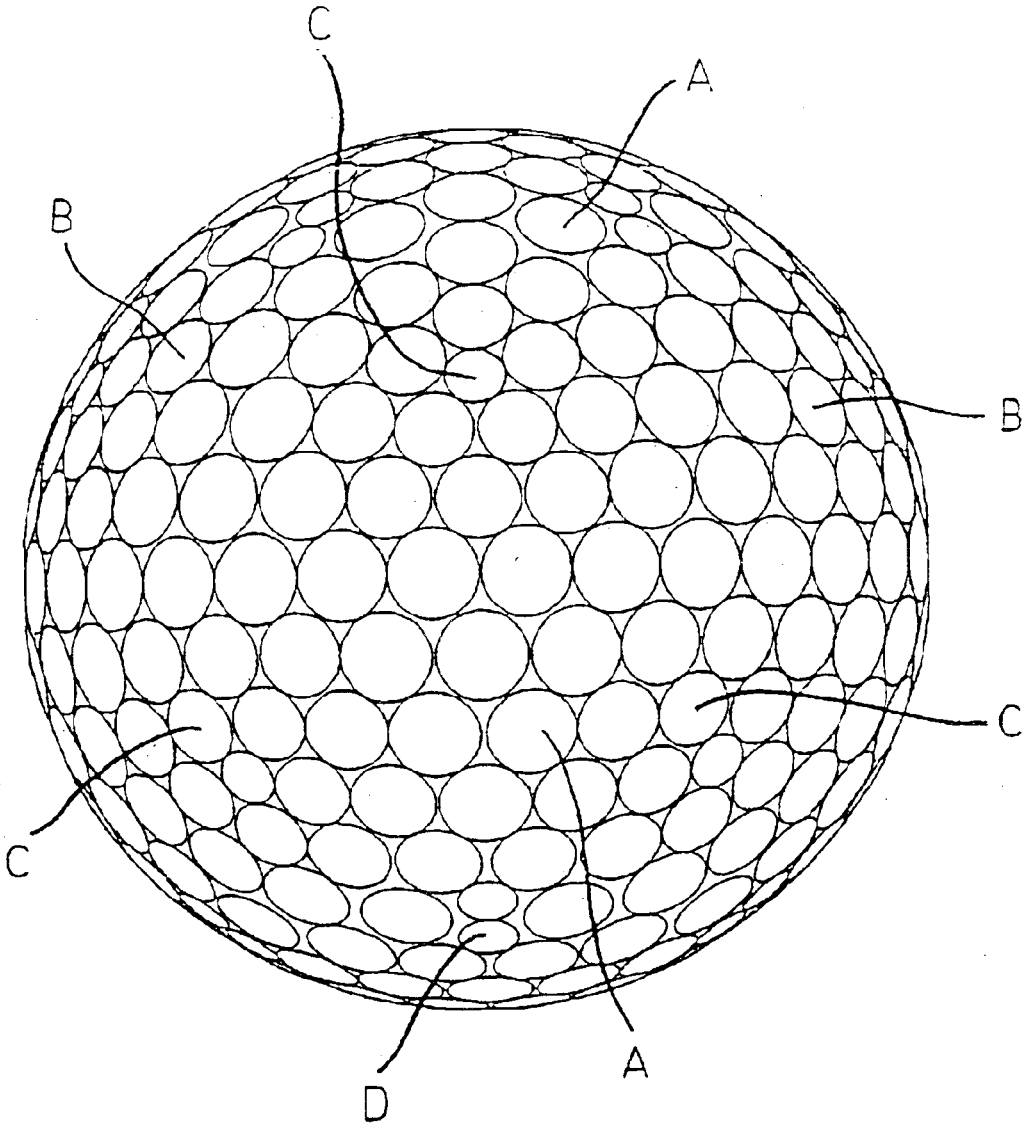
FIG. 2 is a front view showing the golf ball in FIG. 1.

A golf ball shown in FIGS. 1 and 2 usually has a diameter of approximately 42.67 mm to 43.00 mm. The golf ball includes an A dimple having a circular plane shape and a diameter of 4.5 mm, a B dimple having a circular plane shape and a diameter of 4.1 mm, a C dimple having a circular plane shape and a diameter of 3.6 mm, and a D dimple having a circular plane shape and a diameter of 2.8 mm. The number of the A dimples is 130, that of the B dimples is 150, that of the C dimples is 60 and that of the D dimples is 32. The total number of the dimples of the golf ball is 372.

Figure 3:
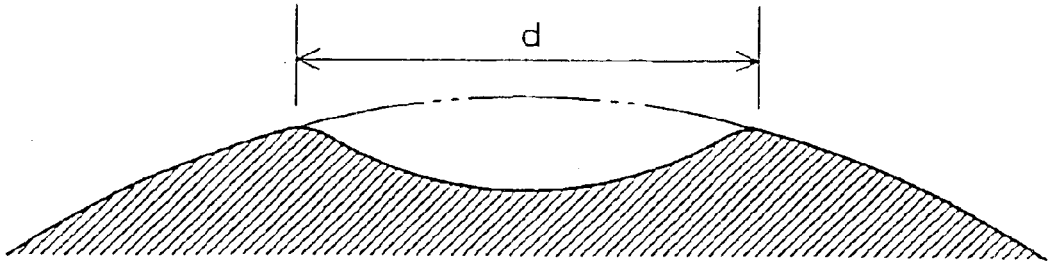
FIG. 3 is a typical enlarged sectional view showing a part of the golf ball in FIG. 1.

FIG. 3 is a typical enlarged sectional view showing a part of the golf ball in FIG. 1. FIG. 3 shows a section taken along the deepest portion of the dimple. In FIG. 3, the diameter of the dimple is shown by an arrow d. The diameter d represents the distance between both contacts with a common tangential line drawn on both ends of the dimple. The dimple volume represents the volume of a portion surrounded by the virtual sphere of the golf ball (which is a sphere on the assumption that the dimple is not present and is shown in a two-dotted line of FIG. 3) and the surface of the dimple.

The area of the dimple represents the area of a region surrounded by the contour of the dimple (that is, the area of a plane shape) when the center of the golf ball is seen at infinity. In the case of the circular dimple, an area 9 is calculated by the following Equation:

$$s=(d/2)^2*\pi$$

In the golf ball shown in FIG. 1, the A dimple has an area s of 15.9 $mm^2$, the B dimple has an area s of 13.2 $mm^2$, the C dimple has an area s of 10.2 $mm^2$, and the D dimple has an area s of 6.2 $mm^2$. Accordingly, the total area S of the dimple areas is 4855.7 $mm^2$. The total area S is divided by the surface area of the virtual sphere so that a surface area occupation ratio Y is calculated. In the golf ball, the surface area occupation ratio Y is 0.848. The surface area occupation ratio Y implies an area ratio at which all the dimples occupy the spherical surface of a virtual sphere. By dividing the surface area occupation ratio Y by the total number of the dimples, a mean occupation ratio y is calculated. In the golf ball, the mean occupation ratio y is 0.00228. The mean occupation ratio y implies an area ratio at which dimple having a mean area occupy the spherical surface of the virtual sphere.

In the case in which a designer is to design a dimple pattern having a high surface area occupation ratio Y, he (she) can use means for increasing the number of the dimples and means for increasing the diameter d of the dimple. When the designer mainly employs the means for increasing the diameter d to achieve the surface area occupation ratio Y, a golf ball having a mean occupation ratio y of 0.00220 or more is obtained.

If the mean occupation ratio y is less than 0.00220, the drag coefficient (Cd) is increased in a region in which the flight speed is high, resulting in an insufficient flight distance of the golf ball. In this respect, the mean occupation ratio y is more preferably 0.00225 or higher, further preferably 0.00230 or higher, and particularly preferably 0.00250 or more. The golf ball having an extremely high mean occupation ratio y is hard to design with respect to the maintenance of the original golf ball features where the golf ball is almost a sphere. Therefore, an ordinary golf ball has a mean occupation ratio y of 0.00300 or less.

It is preferable that the surface area occupation ratio Y should be 0.80 to 0.90. If the surface area occupation ratio Y is less than this range, the lift of the golf ball might become insufficient during flight. In this respect, the surface area occupation ratio Y is more preferably 0.81 or more and more particularly 0.83 or more. If the surface area occupation ratio Y exceeds the range, the trajectory might be too high. In this respect, it is particularly preferable that the surface area occupation ratio Y should be 0.87 or less.

In the golf ball shown in FIG. 1, A dimple has a contour length x of 14.1 mm, the B dimple has a contour length x of 12.9 mm, the C dimple has a contour length x of 11.3 mm and the D dimple has a contour length x of 8.8 mm. In the golf ball, the contour length X is the sum of the contour lengths x, which is 4730.0 mm.

The contour length x of the dimple represents a length measured along the contour of the dimple. For example, in the case in which the dimple has a triangular plane shape, the total length of the three sides is represented by the contour length x. Since these sides are present on a spherical surface, they are not straight lines but circular arcs in a strict sense. The length of the circular arc is set to be the length of the side. In the case of a circular dimple, the contour length x is calculated by the following Equation:

$$x=d*\pi$$

It is preferable that the surface area occupation ratio Y and the total contour length X should satisfy the relationship in the following expression (I).

$$X\leqq 3882*Y+1495 \quad \text{(I)}$$

The golf ball has a smaller total contour length X as compared with the surface area occupation ratio Y. The golf ball has a small drag coefficient (Cd) during a flight and an excellent flight performance. In the knowledge of the inventor, there has not been a golf ball satisfying the expression (I).

In respect of a reduction in the drag coefficient (Cd), it is more preferable that the total contour length X and the surface area occupation ratio Y should satisfy the following expression (II), further preferably the following expression (III), and particularly preferably the following expression (IV).

$$X\leqq 3882*Y+1445 \quad \text{(II)}$$

$$X\leqq 3882*Y+1335 \quad \text{(III)}$$

$$X\leqq 3882*Y+1085 \quad \text{(IV)}$$

In order to maintain the original feature that the golf ball is an almost sphere, the total contour length X and the surface area occupation ratio Y are to satisfy the relationship in the following expression (V).

$$X\geqq 3882*Y+95 \quad \text{(V)}$$

The total contour length X is properly determined based oh the relationship with the surface area occupation ratio Y within the range to satisfy the expression (I), and is usually 2800 mm to 5000 mm, particularly, 3100 mm to 4700 mm.

With respect to a reduction in the drag coefficient (Cd), the number of the dimples having a contour length x of 10.5 mm or more is preferably 91% of the total number of the dimples or more, and particularly preferably 95% or more. The ratio is ideally 100%.

While the size of each dimple is not particularly restricted, the circular dimple usually has a diameter d of 2.0 mm to 8.0 mm, and particularly 3.0 mm to 7.0 mm. It is possible to form a dimple of a simple kind or plural kinds. A non-circular dimple (a dimple having no circular plane shape) may be formed in place of the circular dimple or together with the circular dimple.

The total volume of dimples is preferably 300 $mm^3$ to 700 $mm^3$. If the total volume is less than this range, the trajectory might be too high. From this viewpoint, it is particularly preferable that the total volume should be 350 $mm^3$ or more. If the total volume exceeds the range, the trajectory might be lower. From this viewpoint, it is particularly preferable that the total volume should be 600 $mm^3$ or less.

The total number of the dimples is preferably 200 to 500. If the total number is less than this range, it might be hard to cause the golf ball to take on the shape of an almost sphere while maintaining a predetermined surface area occupation ratio Y (in other words, the smoothness of the surface of the golf ball might be damaged). From this viewpoint, it is particularly preferable if the total number should be 250 or more. If the total number exceeds this range, the mean occupation ratio y might be reduced. From this viewpoint, it is particularly preferable that the total number should be 400 or less.

The structure of the golf ball is not particularly restricted and a so-called wound golf ball or a solid golf ball (a one-piece golf ball, a two-pieces golf ball, a three-piece golf ball or the like) may be used. Moreover, the material is not particularly restricted and thus well-known materials can be used.

EXAMPLES

Example 1

A core formed of a solid rubber was put in a mold and an ionomer resin composition was subjected to injection molding to form a cover around the core. The surface of the cover was coated so that a golf ball according to an example 1 which has a dimple pattern shown in a plan view of FIG. 1 and a front view of FIG. 2 was obtained. The golf ball had an outside diameter of approximately 42.70 mm, a weight of approximately 45.4 g, a compression of approximately 93 (by an ATTI compression tester produced by Atti Engineering Co., Ltd.) and a total dimple volume of approximately 500 $mm^3$.

The golf ball includes 130 A dimples having a circular plane shape and a diameter of 4.5 mm, 150 B dimples having a circular plane shape and a diameter of 4.1 mm, 60 C dimples having a circular plane shape and a diameter of 3.6 mm, and 32 D dimples having a circular plane shape and a diameter of 2.8 mm. In the golf ball, the total number of the dimples is 372, atotal contour length X is 4730.0 mm, a surface area occupation ratio Y is 0.848 and a mean occupation ratio y is 0.00228.

Example 2

Figure 4:
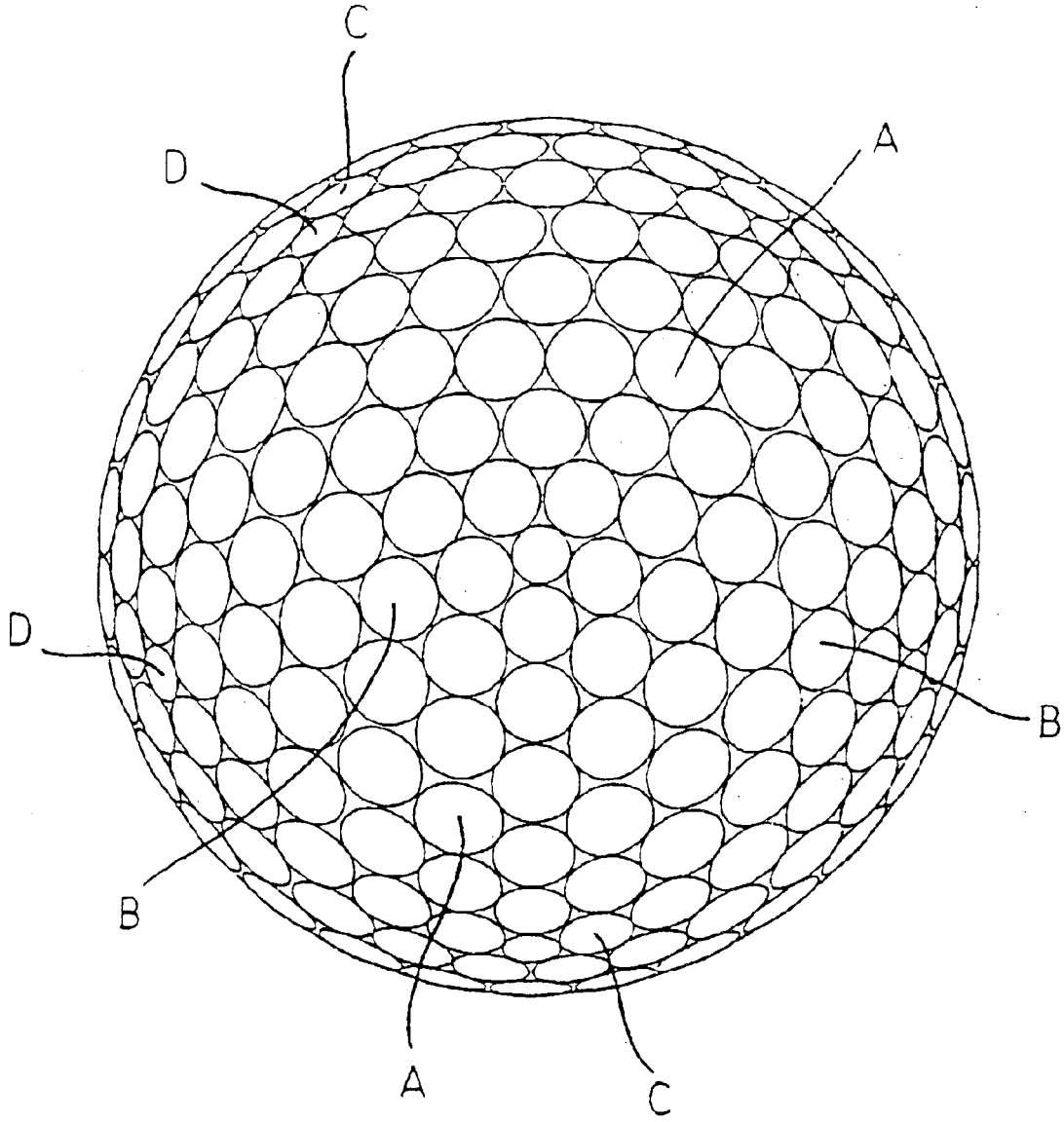
FIG. 4 is a plan view showing a golf ball according to example 2 of the present invention.
Figure 5:
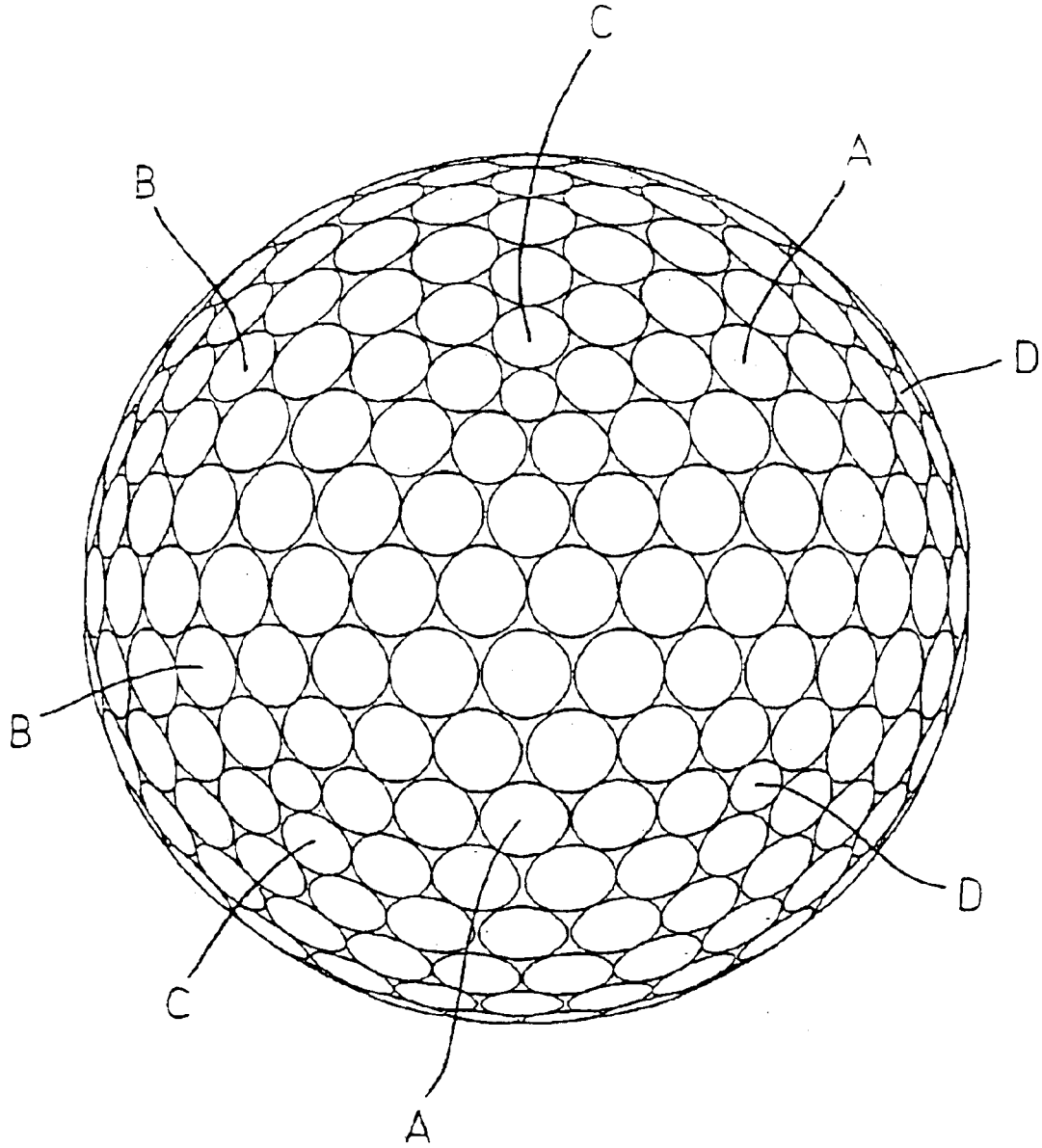
FIG. 5 is a front view showing the golf ball in FIG. 4.

A golf ball according to an example 2 which has a dimple pattern shown in a plan view of FIG. 4 and a front view of FIG. 5 was obtained in the same manner as in the example 1 except that the mold was changed. The golf ball includes 170 A dimples having a circular plane shape and a diameter of 4.4 mm, 120 B dimples having a circular plane shape and a diameter of 4.1 mm, 60 C dimples having a circular plane shape and a diameter of 3.5 mm, and 12 D dimples having a circular plane shape and a diameter of 2.4 mm. In the golf ball, the total number of the dimples is 362, a total contour length X is 4645.8 mm, a surface area occupation ratio Y is 0.838, and a mean occupation ratio y is 0.00232.

Example 3

Figure 6:
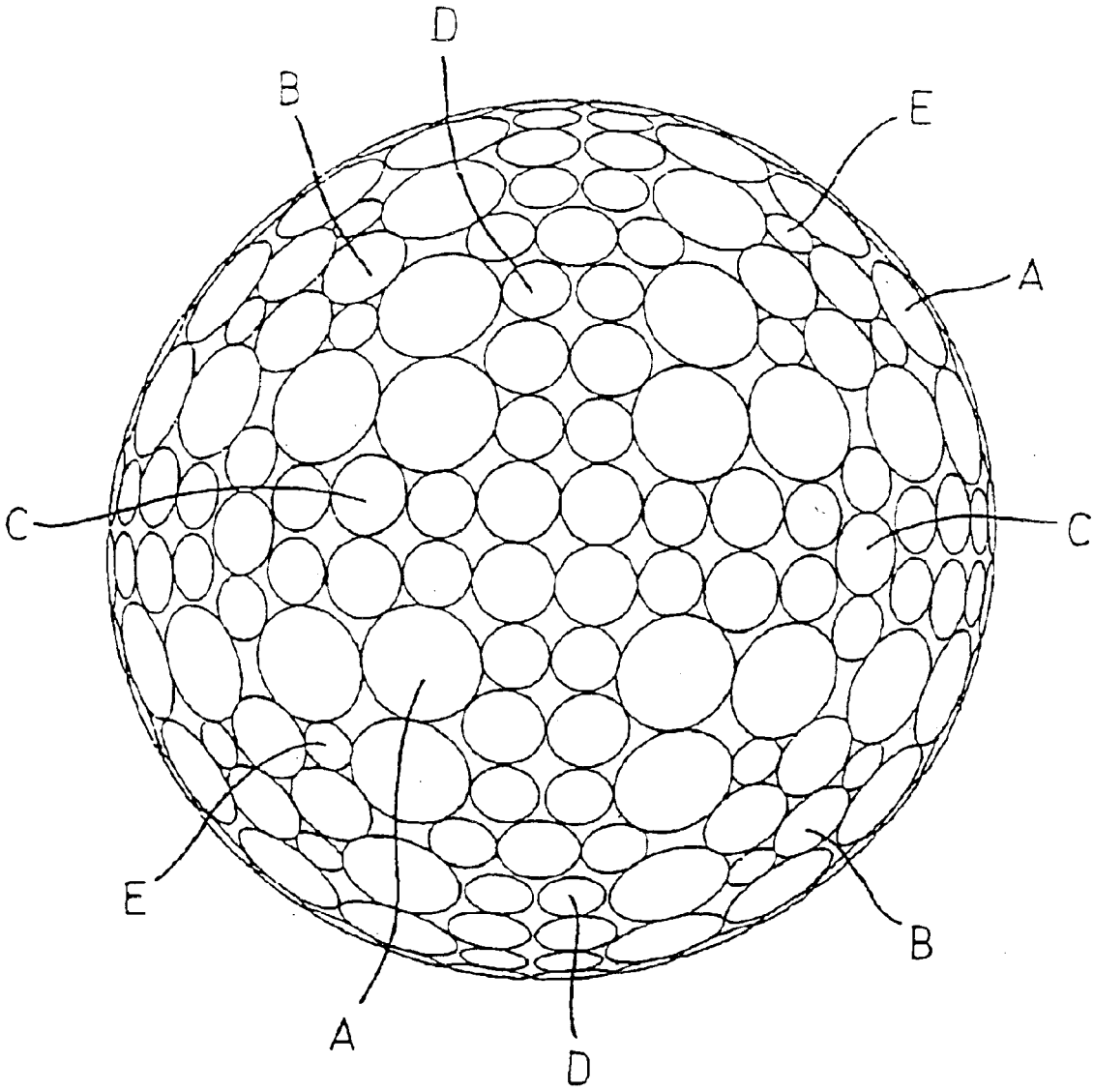
FIG. 6 is a plan view showing a golf ball according to example 3 of the present invention.
Figure 7:
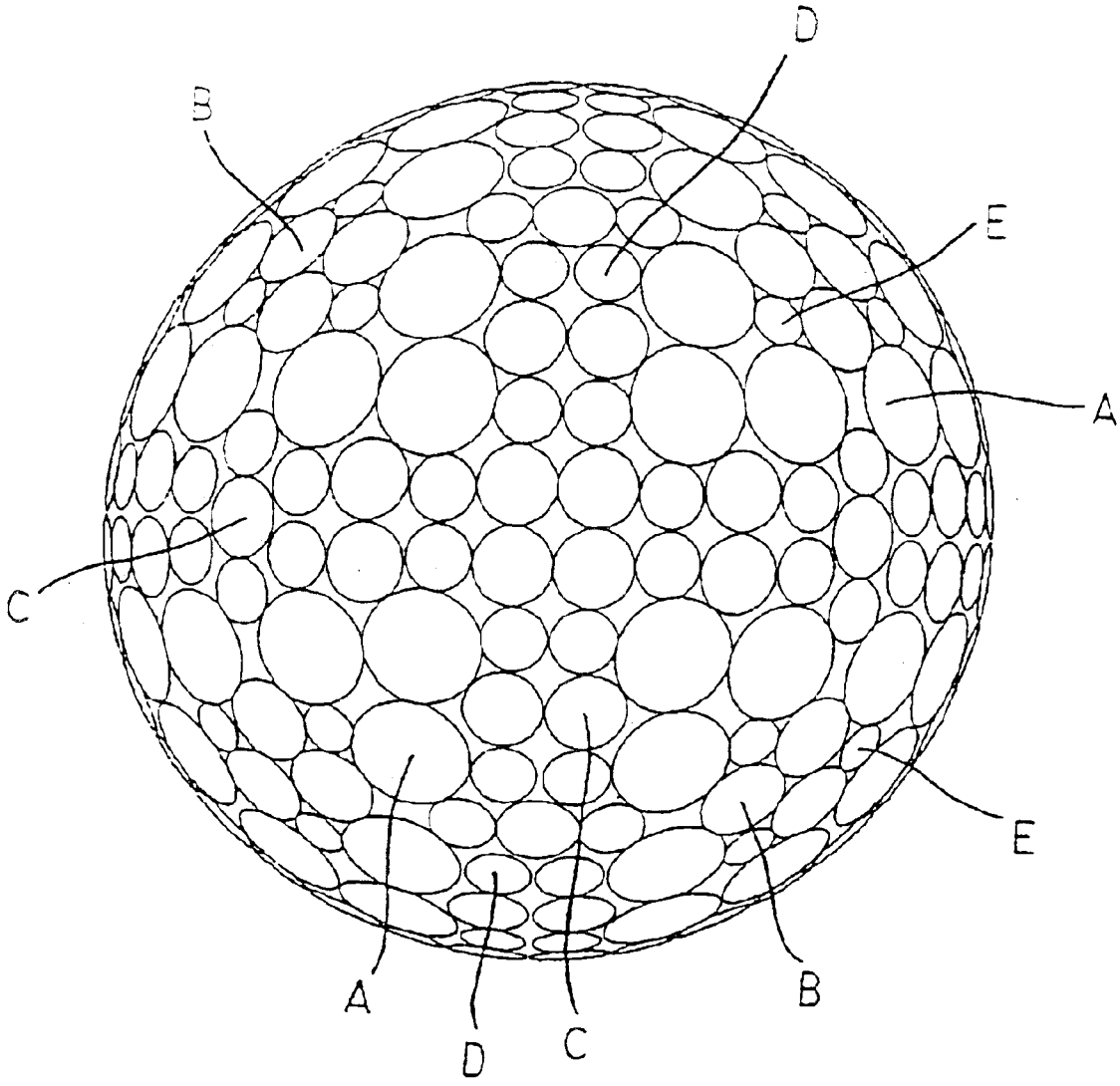
FIG. 7 is a front view showing the golf ball of FIG. 6.

A golf ball according to an example 3 which has a dimple pattern shown in a plan view of FIG. 6 and a front view of FIG. 7 was obtained in the same manner as in the example 1 except that the mold was changed. The golf ball includes 72 A dimples having a circular plane shape and a diameter of 5.9 mm, 24 B dimples having a circular plane shape and a diameter of 4.5 mm, 88 C dimples having a circular plane shape and a diameter of 3.9 mm, 112 D dimples having a circular plane shape and a diameter of 3.6 mm, and 24 E dimples having a circular plane shape and a diameter of 2.8 mm. In the golf ball, the total number of the dimples is 320, a total contour length X is 4229.8 mm, a surface area occupation ratio Y is 0.819, and a mean occupation ratio y is 0.00256.

Comparative Example 1

Figure 8:
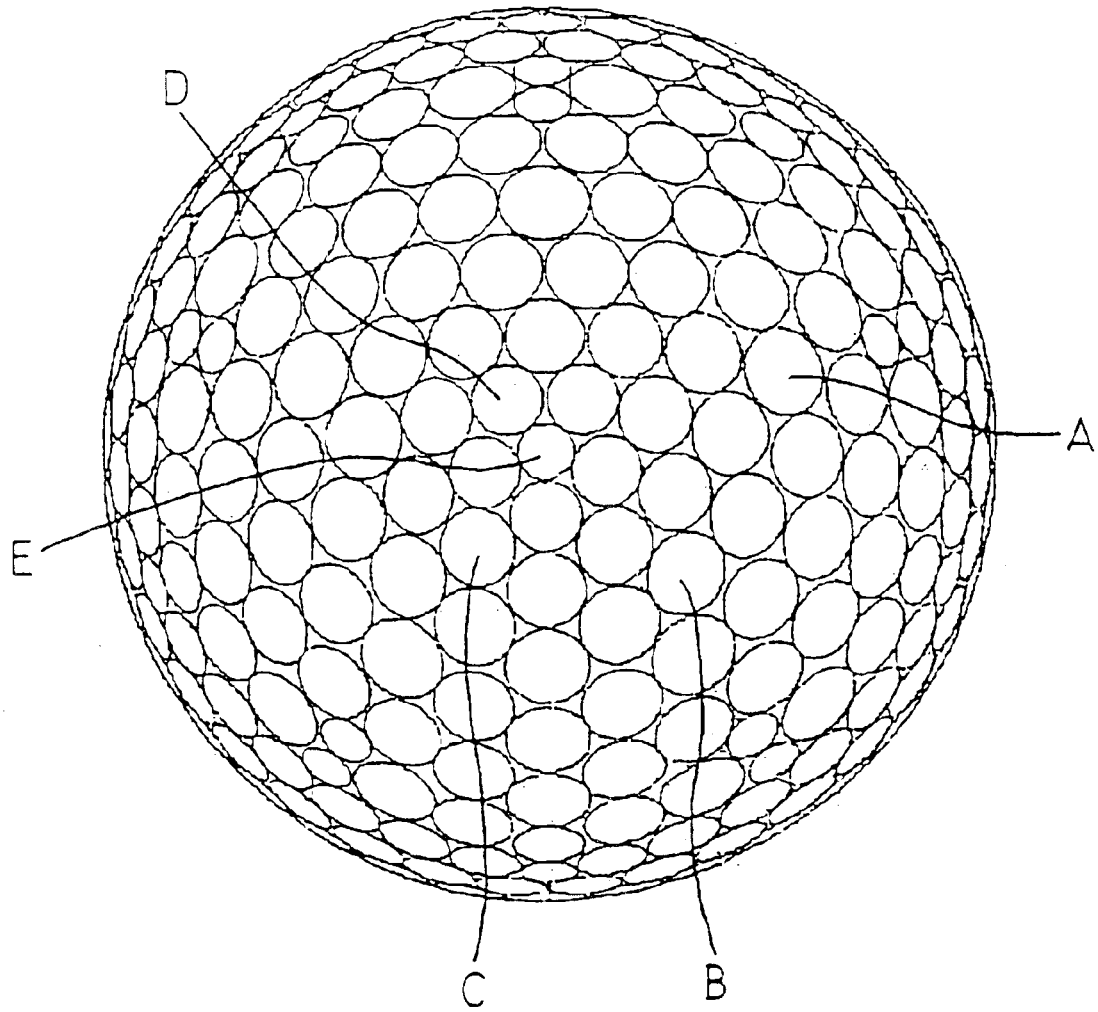
FIG. 8 is a plan view showing a golf ball according to comparative example 1 according to the present invention.
Figure 9:
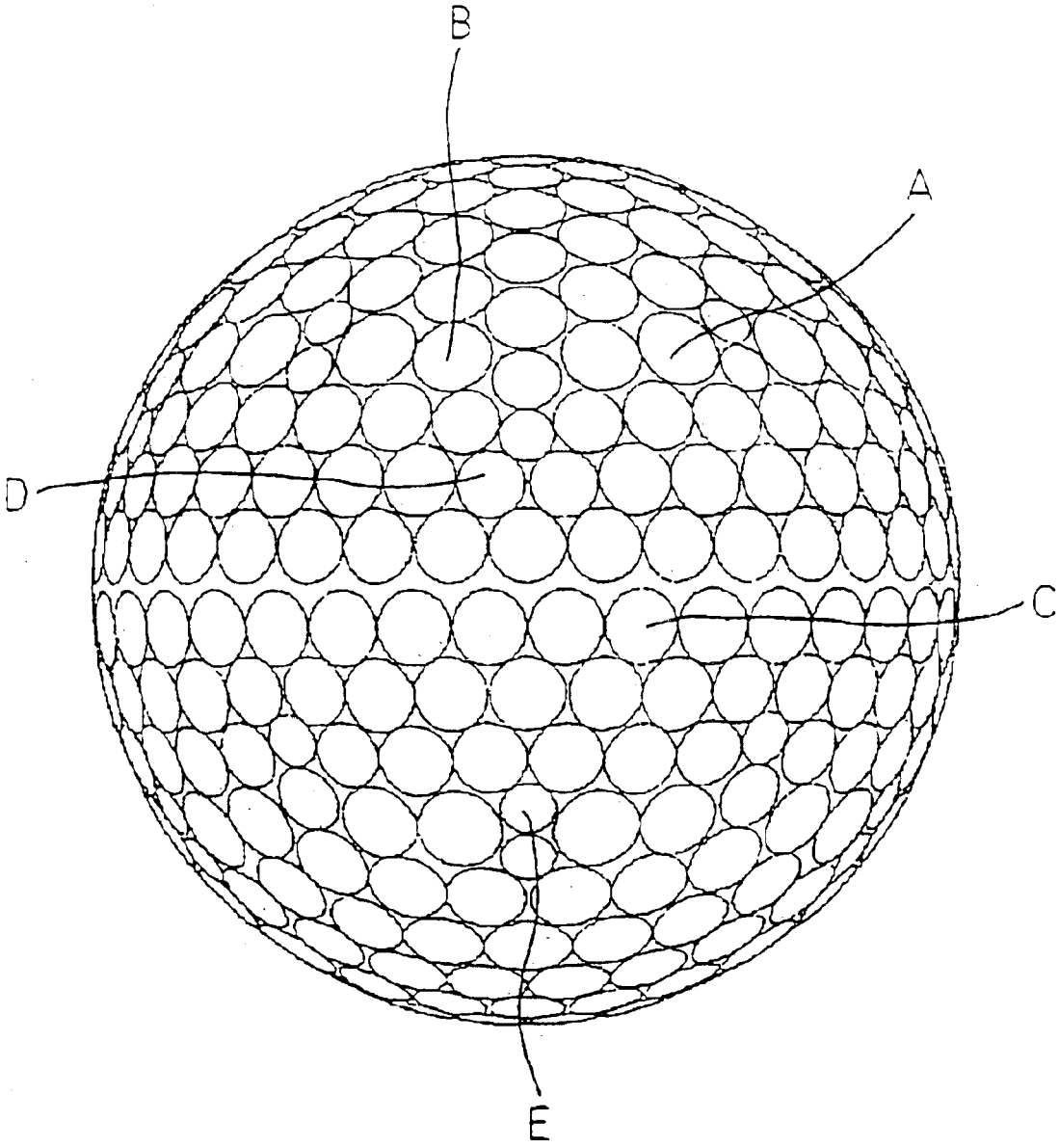
FIG. 9 is a front view showing the golf ball in FIG. 8.

A golf ball according to a comparative example 1 which has a dimple pattern shown in a plan view of FIG. 8 and a front view of FIG. 9 was obtained in the same manner as in the example 1 except that the mold was changed. The golf ball includes 30 A dimples having a circular plane shape and a diameter of 4.3 mm, 130 B dimples having a circular plane shape and a diameter of 4.0 mm, 180 C dimples having a circular plane shape and a diameter of 3.7 mm, 60 D dimples having a circular plane shape and a diameter of 3.4 mm, and 32 E dimples having a circular plane shape and a diameter of 2.8 mm. In the golf ball, the total number of the dimples is 432, a total contour length X is 5053.6 mm, a surface area occupation ratio Y is 0.829, and a mean occupation ratio y is 0.00192. The dimple pattern according to the comparative example 1 has been disclosed as an example 1 in the Japanese Laid-Open Patent Publication No. Hei 4-347177 (U.S. Pat. No. 5,292,132) described above.

Comparative Example 2

Figure 10:
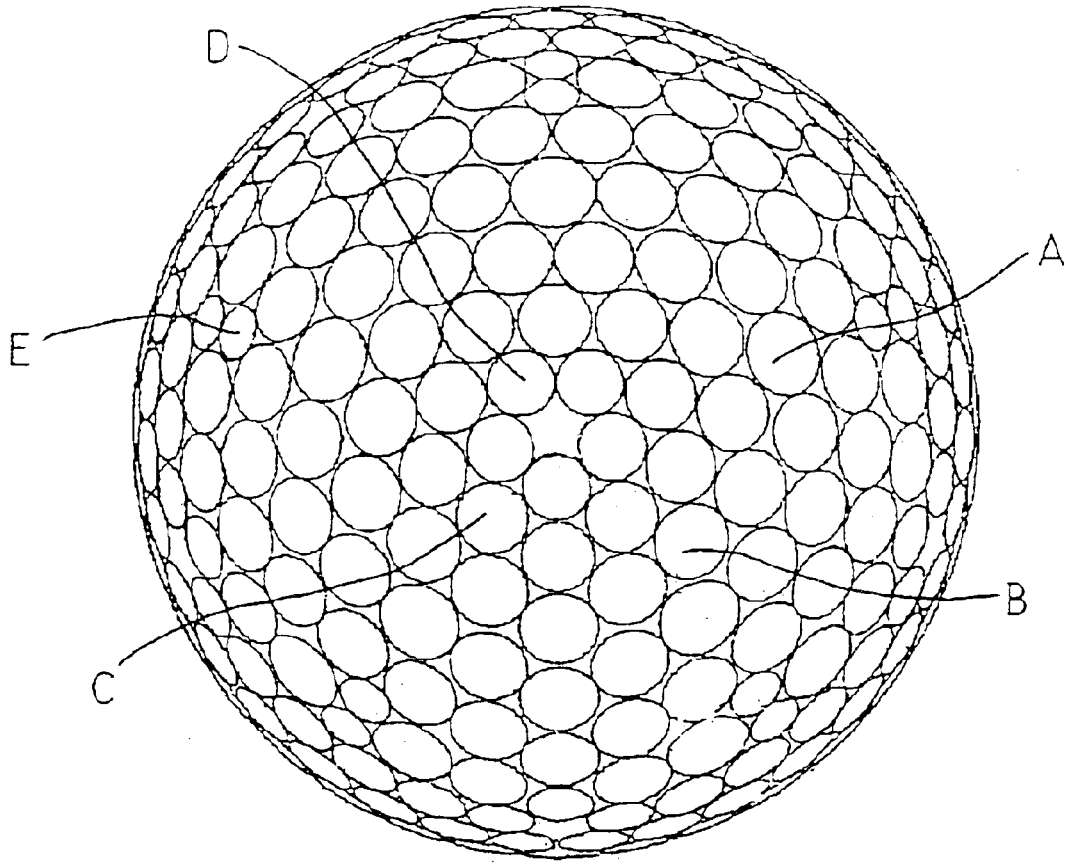
FIG. 10 is a plan view showing a golf ball according to comparative example 2 of the present invention.
Figure 11:
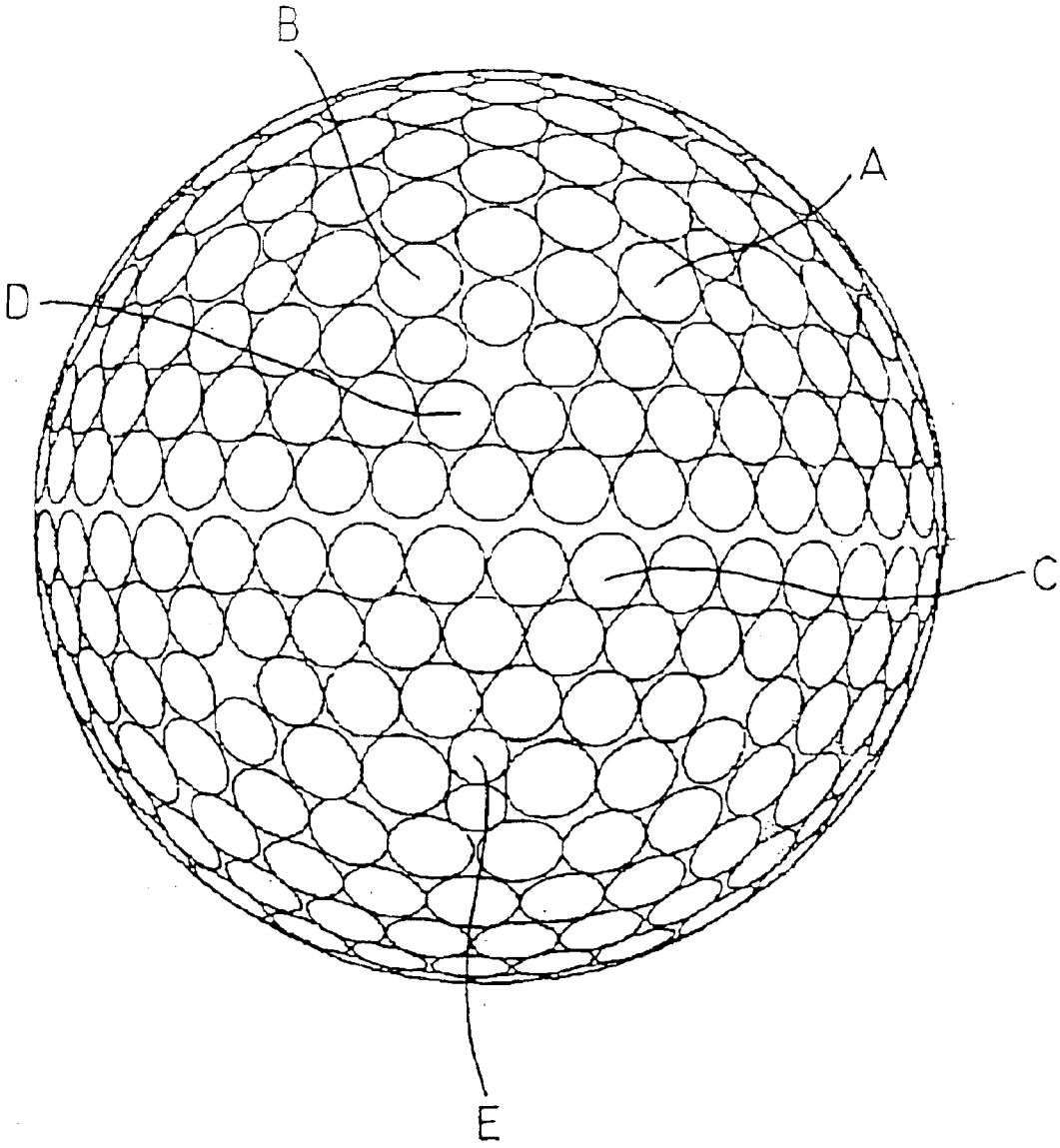
FIG. 11 is a front view showing the golf ball in FIG. 10.

A golf ball according to a comparative example 2 which has a dimple pattern shown in a plan view of FIG. 10 and a front view of FIG. 11 was obtained in the same manner as in the example 1 except that the mold was changed. The golf ball includes 30 A dimples having a circular plane shape and a diameter of 4.3 mm, 130 B dimples having a circular plane shape and a diameter of 4.0 mm, 180 C dimples having a circular plane shape and a diameter of 3.7 mm, 60 D dimples having a circular plane shape and a diameter of 3.4 mm, and 20 E dimples having a circular plane shape and a diameter of 2.8 mm. In the golf ball, the total number of the dimples is 420, a total contour length X is 4948.0 mm, a surface area occupation ratio Y is 0.816, and a mean occupation ratio y is 0.00194. The dimple pattern according to the comparative example 2 has been disclosed as an example 2 in the Japanese Laid-Open Patent Publication No. Hei 4-347177 (U.S. Pat. No. 5,292,132) described above.

Comparative Example 3

Figure 12:
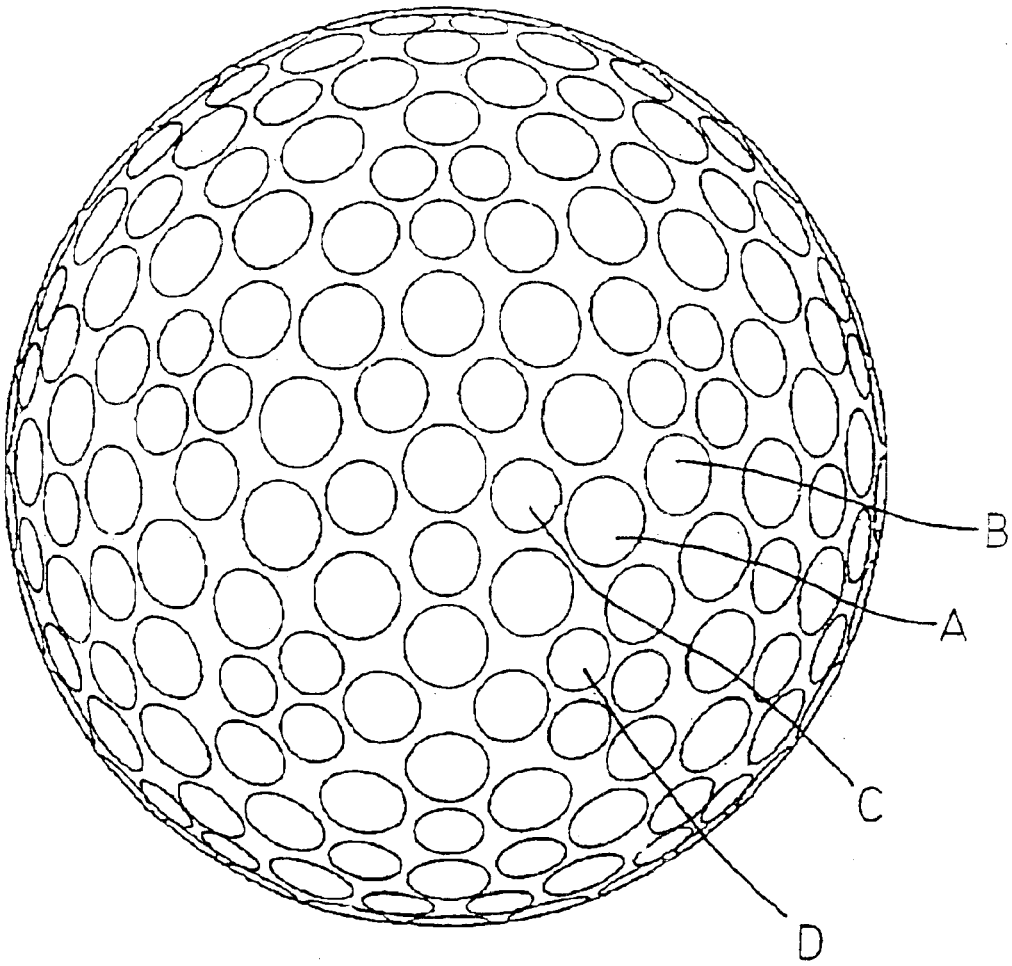
FIG. 12 is a plan view showing the golf ball according to comparative example 3 of the present invention.
Figure 13:
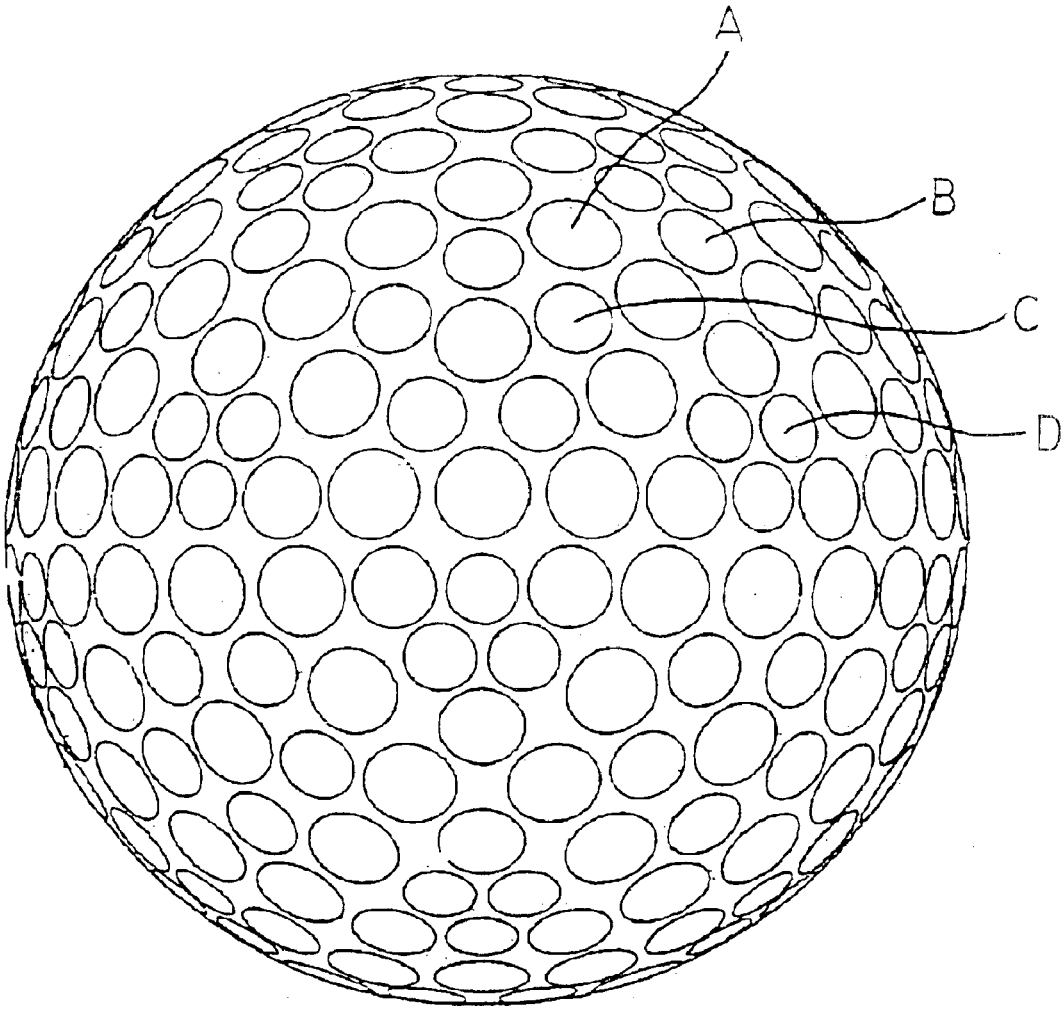
FIG. 13 is a front view showing the golf ball in FIG. 12.

A golf ball according to a comparative example 3 which has a dimple pattern shown in a plan view of FIG. 12 and a front view of FIG. 13 was obtained in the same manner as in the example 1 except that the mold was changed. The golf ball includes 132 A dimples having a circular plane shape and a diameter of 4.4 mm, 60 B dimples having a circular plane shape and a diameter of 4.2 mm, 60 C dimples having a circular plane shape and a diameter of 3.5 mm, and 60 D dimples having a circular plane shape and a diameter of 3.3 mm. In the golf ball, the total number of the dimples is 312, a total contour length X is 3898.1 mm, a surface area occupation ratio Y is 0.686, and a mean occupation ratio y is 0.00220. The dimple pattern according to the comparative example 3 has been disclosed as an example 1 in the Japanese Laid-Open Patent Publication No. Sho 62-192181 (U.S. Pat. No. 4,813,677) described above.,

[Flight Distance Test]

20 golf balls according to each of the examples and the comparative examples were prepared and were maintained at 23° C. On the other hand, a driver comprising a metal head (trade name of "XXIOW#1" produced by Sumitomo Rubber Industries, Ltd., loft: 8 degrees, shaft hardness: X) was attached to a swing machine (produced by Golf Lab Co., Ltd.). Machine conditions were set to have a head speed of 50 m/sec, a back spin amount of approximately 2000 rpm obtained immediately after hitting and a launch angle of approximately 10 degrees, and the golf ball was hit and a flight distance (a distance between a launch point and a stationary point) was measured. The following Tables 1 and 2 show the mean value of the results of measurement for the 20 golf balls.

What is claimed is:

1. A golf ball having a large number of dimples on a surface thereof, wherein the surface area occupation ratio Y of the dimples is 0.80 to 0.90 and a mean occupation ratio y of the dimples, which is a value obtained by dividing the surface area occupation ratio Y by the total number of the dimples is 0.0025 or more.

2. The golf ball according to claim 1, wherein the total contour length X of the dimples and the surface area occupation ratio Y satisfy a relationship indicated by an expression (I):

$$X \leqq 3882*Y+1495 \quad \text{(I).}$$

3. The golf ball according to claim 1, wherein a ratio of the number of dimples having a contour length x of 10.5 mm or more to a total number of the dimples is 91% or more.

TABLE 1

Result of evaluation of golf ball according to example

| | Dimple | | | | | Total | | | | | | |
|---|---|---|---|---|---|---|---|---|---|---|---|---|
| | Kind | Diameter d (mm) | Contour length x (mm) | Number | Ratio (%) | Total number | contour length X (mm) | Total area S ($mm^2$) | Surface area occupation ratio Y | Mean occupation ratio y | Plan view Front view | Flight distance (m) |
| Example 1 | A | 4.5 | 14.1 | 130 | 34.9 | 372 | 4730.0 | 4855.7 | 0.848 | 0.00228 | FIG. 1 | 253.1 |
| | B | 4.1 | 12.9 | 150 | 40.3 | | | | | | FIG. 2 | |
| | C | 3.6 | 11.3 | 60 | 16.1 | | | | | | | |
| | D | 2.8 | 8.8 | 32 | 8.6 | | | | | | | |
| Example 2 | A | 4.4 | 13.8 | 170 | 47.0 | 362 | 4645.8 | 4800.8 | 0.838 | 0.00232 | FIG. 4 | 254.2 |
| | B | 4.1 | 12.9 | 120 | 33.1 | | | | | | FIG. 5 | |
| | C | 3.5 | 11.0 | 60 | 16.6 | | | | | | | |
| | D | 2.4 | 7.5 | 12 | 3.3 | | | | | | | |
| Example 3 | A | 5.9 | 18.5 | 72 | 22.5 | 320 | 4229.8 | 4689.2 | 0.819 | 0.00256 | FIG. 6 | 256.3 |
| | B | 4.5 | 14.1 | 24 | 7.5 | | | | | | FIG. 7 | |
| | C | 3.9 | 12.3 | 88 | 27.5 | | | | | | | |
| | D | 3.6 | 11.3 | 112 | 35.0 | | | | | | | |
| | E | 2.8 | 8.8 | 24 | 7.5 | | | | | | | |

TABLE 2

Result of evaluation of golf ball according to comparative example

| | Dimple | | | | | Total | | | | | | |
|---|---|---|---|---|---|---|---|---|---|---|---|---|
| | Kind | Diameter d (mm) | Contour length x (mm) | Number | Ratio (%) | Total number | contour length X (mm) | Total area S ($mm^2$) | Surface area occupation Y | Mean occupation ratio y | Plan view Front View | Flight distance (m) |
| Comparative example 1 | A | 4.3 | 13.5 | 30 | 6.9 | 432 | 5053.6 | 4746.5 | 0.829 | 0.00192 | FIG. 8 | 248.2 |
| | B | 4.0 | 12.6 | 130 | 30.1 | | | | | | FIG. 9 | |
| | C | 3.7 | 11.6 | 180 | 41.7 | | | | | | | |
| | D | 3.4 | 10.7 | 60 | 13.9 | | | | | | | |
| | E | 2.8 | 8.8 | 32 | 7.4 | | | | | | | |
| Comparative example 2 | A | 4.3 | 13.5 | 30 | 7.1 | 420 | 4948.0 | 4672.6 | 0.816 | 0.00194 | FIG. 10 | 247.3 |
| | B | 4.0 | 12.6 | 130 | 31.0 | | | | | | FIG. 11 | |
| | C | 3.7 | 11.6 | 180 | 42.9 | | | | | | | |
| | D | 3.4 | 10.7 | 60 | 14.3 | | | | | | | |
| | E | 2.8 | 8.8 | 20 | 4.8 | | | | | | | |
| Comparative example 3 | A | 4.4 | 13.8 | 132 | 42.3 | 312 | 3898.1 | 3928.8 | 0.686 | 0.00220 | FIG. 12 | 242.3 |
| | B | 4.2 | 13.2 | 60 | 19.2 | | | | | | FIG. 13 | |
| | C | 3.5 | 11.0 | 60 | 19.2 | | | | | | | |
| | D | 3.3 | 10.4 | 60 | 19.2 | | | | | | | |

As is apparent from the Tables 1 and 2, the golf balls according to the examples 1 to 3 have greater flight distances than those of the golf balls according to the comparative examples 1 to 3. From the results of evaluation, the advantage of the present invention is apparent.

The above description is only illustrative and can be variously changed without departing from the scope of the present invention.

4. The golf ball according to claim 1, wherein the total contour length X of the dimples and the surface area occupation ratio Y satisfy a relationship indicated by an expression (III):

$$X \leqq 3882*Y+1335 \quad \text{(III).}$$

* * * * *